United States Patent [19]

Tacker

[11] Patent Number: 4,919,478

[45] Date of Patent: Apr. 24, 1990

[54] SAFETY OTTOMAN

[75] Inventor: Bill D. Tacker, Okolona, Miss.

[73] Assignee: Super Sagless Corporation, Tupelo, Miss.

[21] Appl. No.: 354,830

[22] Filed: May 22, 1989

[51] Int. Cl.[5] ..... A47C 1/034

[52] U.S. Cl. ..... 297/85; 297/68; 297/433

[58] Field of Search ..... 297/68, 84, 85, 423, 297/433, 434, 436

[56] References Cited

U.S. PATENT DOCUMENTS

| | | | |
|---|---|---|---|
| 4,508,387 | 4/1985 | Gilbert et al. | 297/433 X |
| 4,674,794 | 6/1987 | Pine | 297/85 |
| 4,681,365 | 7/1987 | Pine | 297/85 |

*Primary Examiner*—Peter R. Brown

*Attorney, Agent, or Firm*—Wolf Greenfield & Sacks

[57] ABSTRACT

An ottoman for a chair or sofa wherein the mechanism which carries the ottoman allows it to pivot upwardly or downwardly from its supporting bracket of an obstruction is encountered as the ottoman is retracted. In the event the ottoman pivots in either direction more than a selected angle, the ottoman remains in the pivoted position after the obstruction is removed unless a force is applied to return it to the normal position.

16 Claims, 6 Drawing Sheets

SAFETY OTTOMAN

INTRODUCTION

This invention relates to chairs and other furniture for seating, which have extendable ottomans for supporting the legs of their occupants. Such furniture includes recliners, incliners, combination rocker-recliners, combination lift recliner chairs as well as sofas and loveseats. The ottomans are of the variety which are movable either manually or automatically between a retracted position wherein the ottoman is stored beneath the seat and an extended or operative position wherein the ottoman is elevated to a position in front of and approximately at the level of the seat.

In recent years, furniture manufacturers have become aware of the dangers which are encountered when an ottoman is moved from the extended to the retracted position. Each year a significant number of injuries occur when infants, small animals and even the chair occupants have a part of their body trapped behind the ottoman as it is withdrawn from the elevated to the retracted position beneath the seat. Small children or pets who are unnoticed playing about the chair can extend an extremity behind the ottoman and incur serious injury when the ottoman is retracted. The injuries incurred may be particularly extreme when the ottoman is power driven. One approach taken by the industry to solve the problem is to enclose the sides and top of the ottoman assembly so as to make more difficult access to the space behind the ottoman when it is elevated. This does not, however, prevent access from the front of the chair. Another approach, exemplified in U.S. Pat. No. 4,621,863, is to detachably secure the footrest of the ottoman assembly to the mechanism which supports it so that if an obstruction is encountered as the assembly closes the footrest merely detaches from the mechanism and thereby releases any object lodged behind it. Yet another approach as shown in U.S. Pat. Nos. 4,674,794 and 4,681,365 is to provide a number of pivot links in the ottoman assembly, which enable the footrest to pivot up or down on the mechanism from its normal position when an object is encountered behind the footrest as the ottoman assembly closes.

In accordance with the present invention, the footrest of the ottoman assembly is also pivotally mounted with respect to the supporting mechanism so that any object encountered behind it as the assembly is retracted or closed may be readily removed and thereby avoid serious injury. In the embodiment shown, the ottoman assembly is mounted on a conventional lazy tong linkage which moves the assembly between its extended and retracted positions. The ottoman assembly includes a pair of brackets, one mounted on each side of the chair on separate lazy tong linkages, and each bracket in turn carries an ottoman angle. Each ottoman angle is connected to its respective bracket by a pin and slot connection and a coil spring also interconnects the angle and bracket so as to urge the angle to a "normal" position on the bracket. The angles and brackets have parallel plates oriented in vertical planes parallel to the sides of the chair or other furniture on which the ottoman assembly is used. Each bracket also includes a bearing edge which is oriented vertically when the ottoman assembly is retracted, and a pair of stops on each angle adjacent its top and bottom serve as sliding pivots for the angle on the bracket when the footrest of the ottoman assembly moves from the "normal" position. The angles carry the ottoman board which in turn supports the footrest. As the ottoman assembly is retracted and the ottoman board and footrest move from a generally horizontal position at the approximate elevation of the seat to a retracted vertical position beneath the seat, if an obstruction is encountered such as created by an infant or pet or any inanimate object engaging the back of the ottoman board and/or footrest, the footrest will pivot upwardly or downwardly depending upon the location of the obstruction. The motion is permitted by the pin and slot connections along with the springs joining the brackets and angles.

This invention will be better understood and appreciated from the following detailed description and accompanying drawings of a preferred embodiment thereof.

BRIEF FIGURE DESCRIPTION

DETAILED DESCRIPTION

Figure 1:
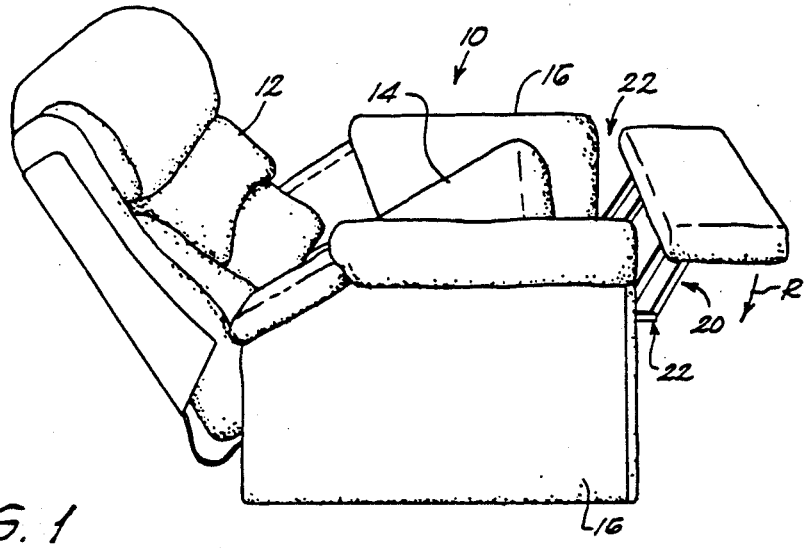
FIG. 1 is a perspective view of a typical reclining chair in which the safety ottoman of this invention is incorporated, and showing the chair in the reclining position with the ottoman assembly extended.
Figure 2:
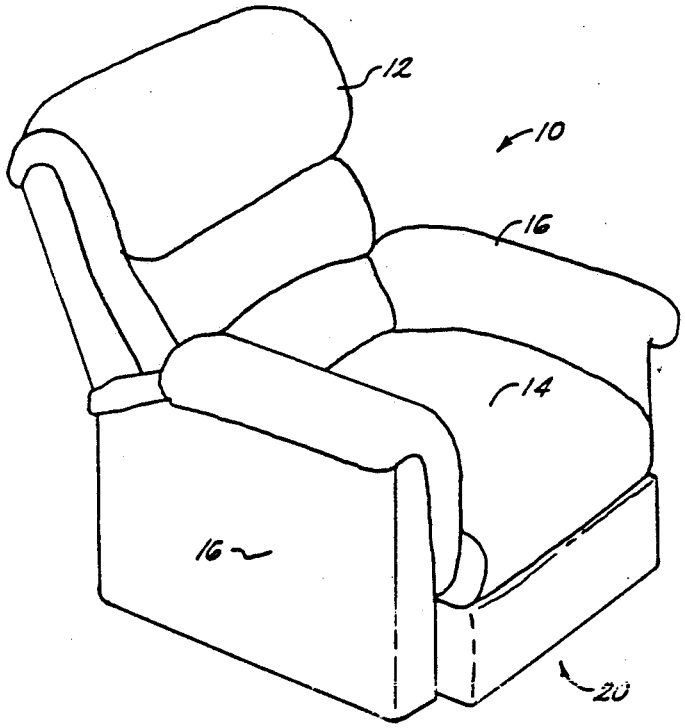
FIG. 2 is a perspective view of the chair of FIG. 1 but in an upright position with the ottoman assembly retracted.

The chair 10 shown in FIGS. 1 and 2 incorporating the safety ottoman of the present invention includes a back 12, seat 14, arms 16 and the safety ottoman assembly 20. The chair may be any one of a variety of lift and/or recliner chairs, either manually or motor powered. Linkage mechanisms (not shown) disposed essentially beneath the seat and between the arms afford motion to those parts of the chair which move during the lift and/or reclining action. The chair illustrated may also represent a section of a sofa into which the safety ottoman may be incorporated.

Typically, ottomans used in the types of chairs described are movable between a retracted "non-use" position wherein the leg rest of the ottoman (which supports the legs of the chair occupant when in use) is disposed in a vertical plane beneath the front edge of the seat as in FIG. 2 and an elevated "use" position wherein the leg rest is disposed in a substantially horizontal plane at the approximate height of the front edge of the seat and spaced a short distance in front of it as in FIG. 1. In FIG. 1, the ottoman assembly 20 is shown carried by lazy tong linkages 22 which are typical of those very extensively used in chairs and sofas to support the ottoman assemblies and afford them the motion between the retracted and extended positions described. The lazy tong linkages, only parts of which are shown, include a pair of links 24 and 26.

It should be appreciated that the lazy tong linkages 22 are duplicated on each side of the chair, and the two sets of linkages are mirror images of one another. Each linkage 22 supports one side of the ottoman assembly, and the two linkages work in unison to enable the ottoman assembly to move between the two extreme positions of FIGS. 1 and 2. The ottoman assembly 20 also has duplicate parts attached to each of the lazy tong linkages. Because the linkages and ottoman assembly parts are duplicates of one another on each side of the chair, only one is described in detail.

Figure 6:
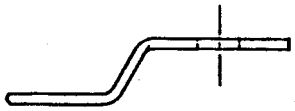
FIGS. 6 and 7 are fragmentary top and end views of the ottoman bracket, respectively, viewed along corresponding sight lines of FIG. 3.
Figure 7:
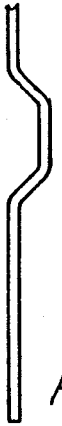
Figure 3:
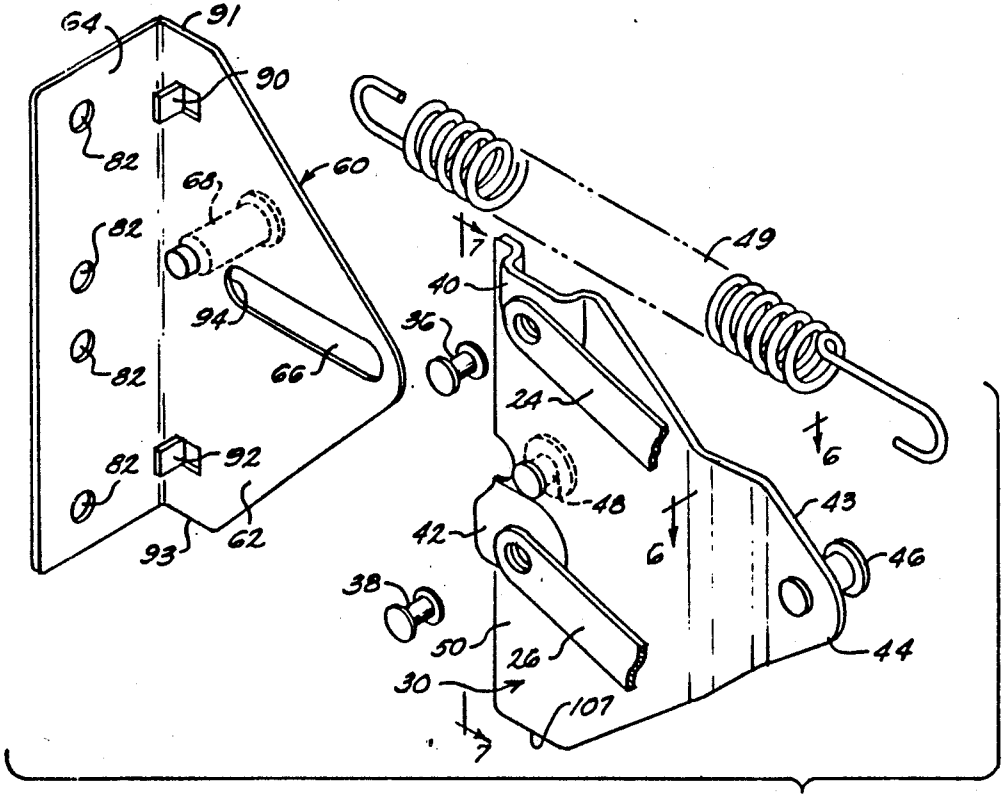
FIG. 3 is an exploded perspective view of one side of the ottoman assembly.
Figure 4:
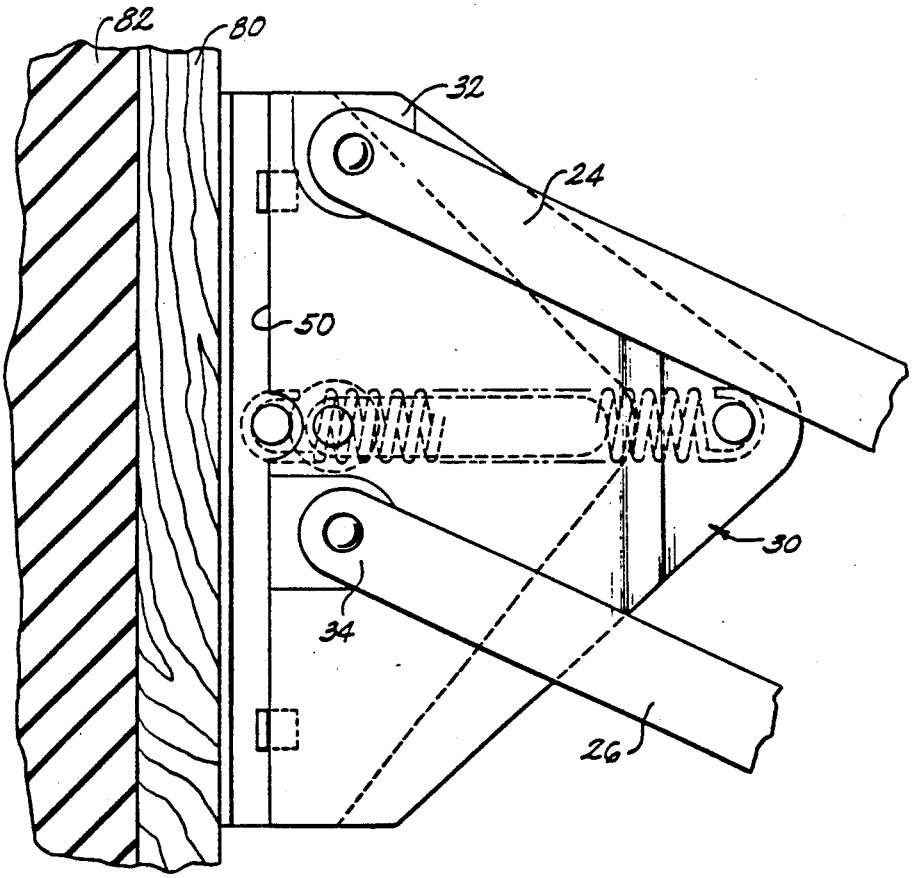
FIG. 4 is a side view, partly in cross section, of the assembled ottoman assembly shown in the "normal" and retracted position.

As shown in FIGS. 3-5 A through F the links 24 and 26 of the lazy tong linkage 22 carry a generally triangular ottoman bracket 30 at their forward ends 32 and 34 by means of a pair of pivot rivets 36 and 38. (When the ottoman is extended, the links 24 and 26 are in the position suggested in FIGS. 1,3 and 5 and when the ottoman is retracted, the links are nearly vertical with their ends 32 and 34 disposed at their tops.) In FIGS. 3, 6 and 7, the bracket 30 is shown in detail. The bracket comprises a plate 31 oriented in a perpendicular plane parallel to the side of the chair. The plate 31 includes offset portions 40 and 42 where the rivets 36 and 38 pass through it so as to accommodate the rivet heads on the outside face 43 of the bracket 30. The apex 44 of the bracket 30 is also offset as shown in FIG. 6, and at its apex 44 carries a post 46 on its outside surface 43 that serves as an anchor for one end of a coil spring 49 described in detail below Bracket 30 also carries a pin 48 adjacent its front edge 50 on the outside surface 43, that supports ottoman angle 60 on the bracket. The edge 50 serves as a bearing edge for the angle 60 as is also explained more fully below. When the ottoman assembly is retracted to the position of FIG. 2, the bearing edge 50 is generally vertical, and when the ottoman assembly is extended to the position of FIG. 1, the edge 50 is substantially horizontal.

The ottoman angle 60 shown in FIGS. 3 and 4 comprises a plate 62 and flange 64 disposed in mutually perpendicular planes. The plate 62 is of generally the same shape as the bracket 30 and has a straight slot 66 which receives the pin 48 carried on the bracket. Aligned with the end of slot 66 on the plate 62 is a pin 68 which supports the other end of the spring 49. When the angle 60 is mounted on the bracket 30 by means of the pin 48 and slot 66, the spring 49 draws the angle 60 rearwardly on the bracket 30 in the direction of the bracket apex 44. (The pin 48 engages the front end 94 of slot 66.)

The flange 64 of angle 60 is connected to one end of ottoman board 80 which in turn extends across the front of the chair, and the other end of the board 80 is connected to the flange of the other angle of the ottoman assembly. The ottoman board may be a variety of different shapes, and conventionally it carries an upholstered footrest 82 upon which the chair occupant rests his or her legs when the ottoman assembly is extended. A number of holes 82 are provided in the flange 64 of angle 60 to facilitate mounting the board 80 on the angle.

A pair of stops 90 and 92 located adjacent the top and bottom edges 91 and 93 of plate 62 are bent out of the plane of the plate 62. When the ottoman angle 60 is in the "normal" position with respect to the bracket 30, the stops 90 and 92 lie very closely adjacent to or actually engage the front edge 50 of the bracket 30. (See FIGS. 4 and 5A) The stops 90 and 92 may serve to limit the rearward travel of the angle on the bracket, or the front end 94 of the slot 66 may do so depending upon the geometry of the bracket and angle. In the absence of any substantial forces being applied to either the top or bottom edges 95 and 97 of the footrest 82 and board 80, the stops 90 and 92 prevent any relative pivotal motion of the angle 60 on the bracket 30 about the pin 48 in slot 66.

Figure 5A:
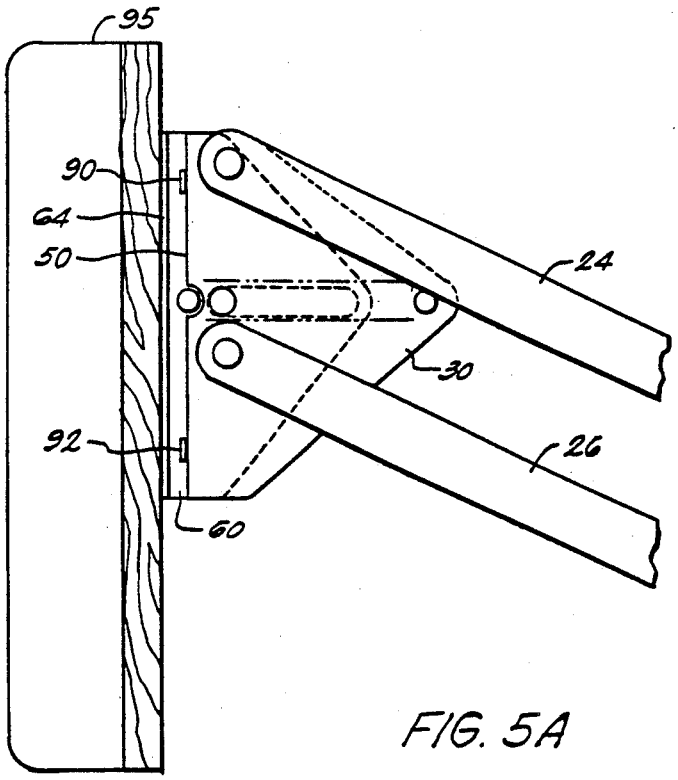
FIG. 5A–5F are side views showing the various positions of the leg rest of the ottoman assembly.
Figure 5B:
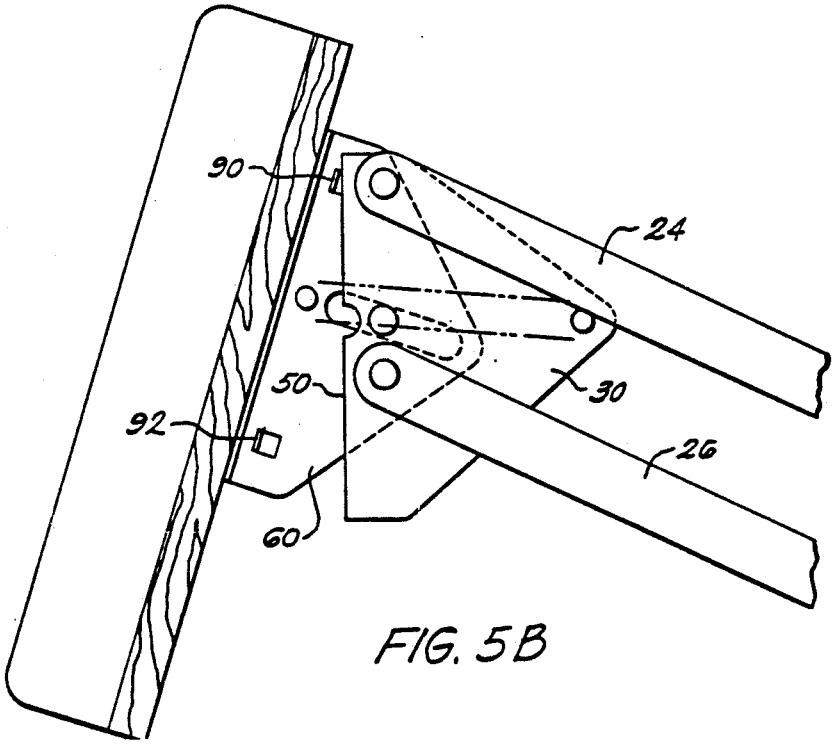
Figure 5C:
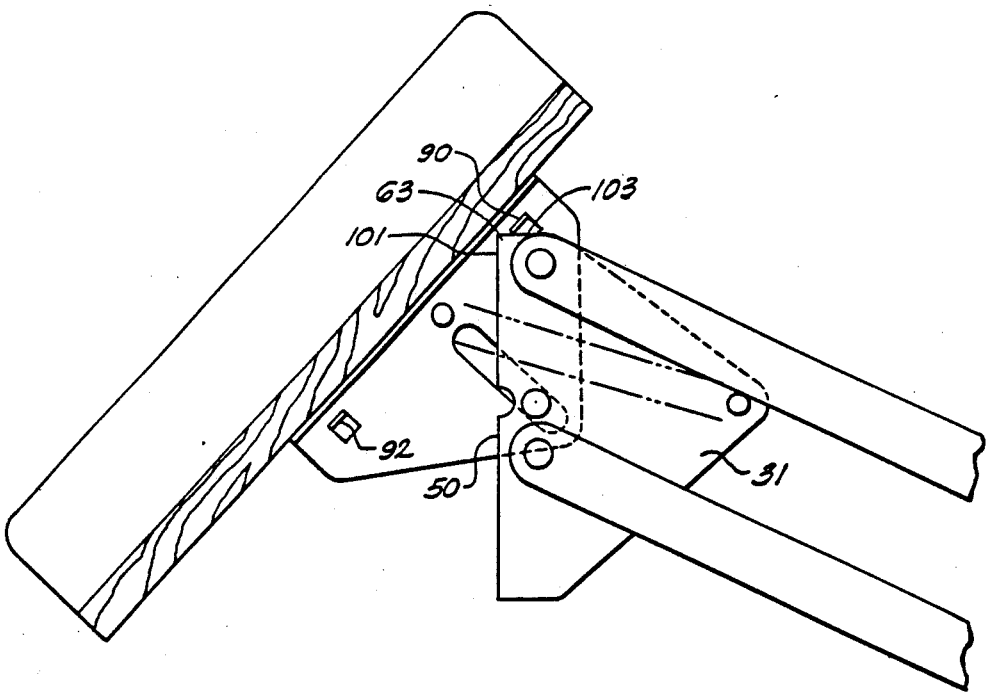
Figure 5D:
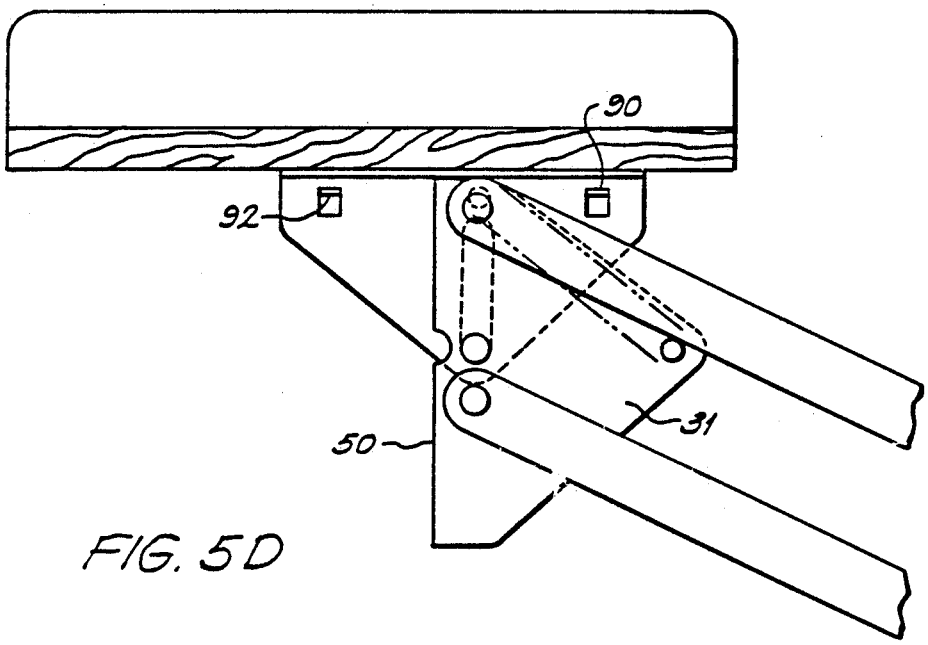

The manner in which the bracket 30 and ottoman angle 60 are connected together by means of the pin 48, slot 66, and spring 49 enables the angle 60 to swing through a variety of positions on the ottoman bracket 30. Several such positions of the ottoman angle 60 are suggested in FIGS. 5B-5F. The so called "normal" angle position with respect to bracket 3 is shown in full lines in FIG. 5A wherein the flange 64 is parallel to the front edge 50 of the bracket 30. In FIG. 5B, a slightly displaced ottoman angle is shown. In that position, the angle upwardly slightly about the pivot point established by the contact of the stop 90 with the edge 50 of the bracket. When the angle is displaced in that fashion on the bracket 30, the slot 66 of the angle moves forwardly on the pin 48. In FIG. 5C, the angle 60 is shown tilted upwardly substantially beyond the position of FIG. 5B, and the stop 90 has slipped above the upper end 101 of the front edge 50 of the bracket so that the angle flange 64 is approximately 45° angle to the edge 50. In FIG. 5D the angle 60 is tilted beyond the position of FIG. 5C so that the flange 64 rests on the flat upper edge of the bracket 30 and lies substantially perpendicular to edge 50.

Figure 5E:
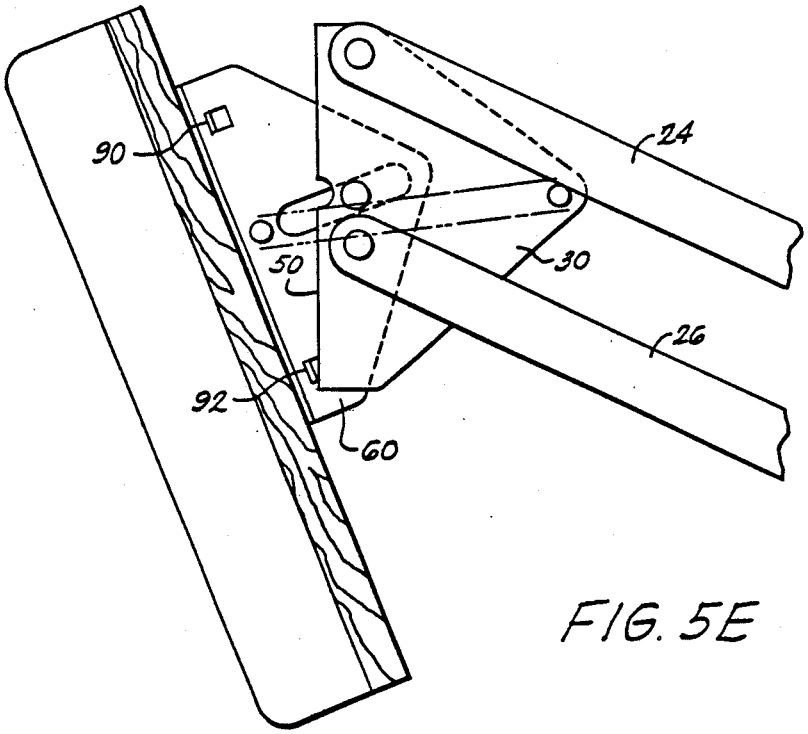
Figure 5F:
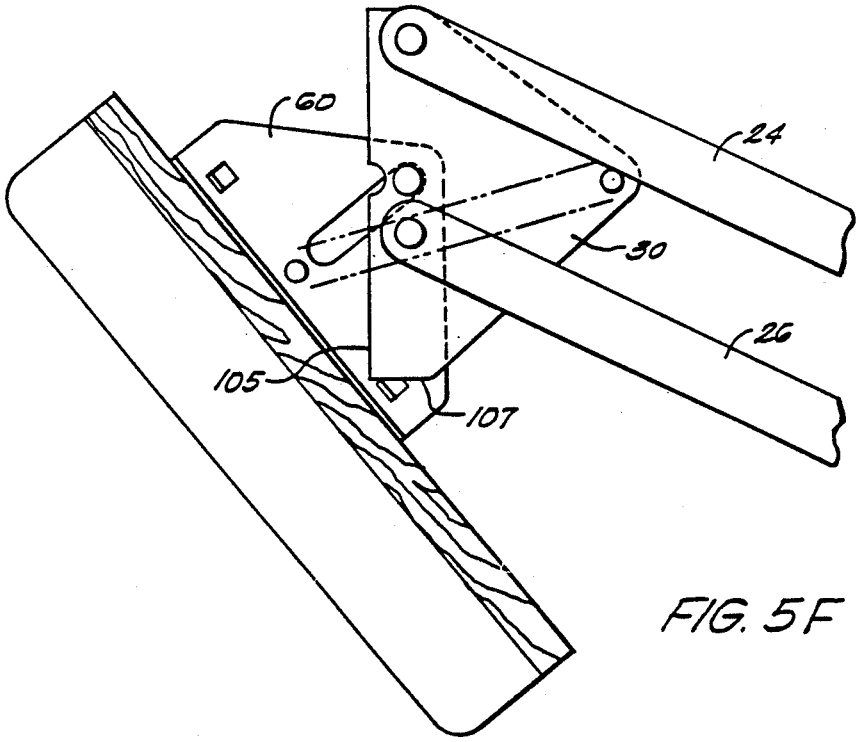

The spring 49 will continuously urge the angle 60 to return to the position shown in FIG. 5A so long as the direction of its force lies below the pivot point of the angle 60 on the bracket. Therefore, so long as the pivot point is established by the stop 90 on edge 50, the center line of the FIGS. 5E and 5F suggest how the angle 60 may pivot downwardly on the bracket 30. In FIG. 5E, the angle 60 is shown tilted downwardly to a position which essentially corresponds to the upwardly tilted position of FIG. 5B. In the position of FIG. 5E, the angle has pivoted about the stop 92 bearing against the lower portion of edge 50, against the action of spring 49, which continuously urges the angle to return to the "normal" position. In the position of FIG. 5F, the angle 60 has tilted further downwardly wherein the stop 92 has slipped off the bottom end 105 of edge 50. While in the position of FIG. 5F, spring continues to urge the angle 60 to return to the "normal" position, the stop 92 bearing against the lower edge 107 of the bracket resists that motion, and the spring alone is insufficient to return the angle.

It will be appreciated from a close inspection of FIGS. 4 and 5A-F that the angle 60 is not spring will lie below that pivot point, and it will urge the angle to return to the so-called "normal" position. The force of spring 49 will not, however, return the angle to the "normal" position of FIG. 5A after the stop 90 slides off the upper end 101 of the edge 50 as in FIG. 5C. In that position, the torque exerted by the force of spring 49 below the pivot point established by th upper corner 63 of the edge 50 against flange 64 is insufficient to overcome the resistance provided by the stop 90 hanging on the upper edge 103 of the bracket. Therefore, the angle 60 will remain in the position of FIG. 5C until it is forceably pushed to cause the stop 90 to slide off the edge 103 over corner 63. When the angle 60 is further elevated beyond the position of FIG. 5C toward the position of FIG. 5D, the spring will pass over the center of the pivot point and carry the angle to the position of FIG. 5D wherein the flange 60, board 80 and footrest 82 are perpendicular to the edge 50 of the bracket 30.

symmetrical about the center line of the slot 66. Rather, the stop 90 lies appreciably closer to the center line of slot 66 than does the stop 92. Furthermore, the upper edge 91 of the angle lies closer to the center line of slot 66 than does its lower edge 93. As a result, a smaller upward tilt of angle 60 is required to cause the stop 90 to slip beyond the upper end 101 of the edge 50 than the tilt of the angle downwardly required to cause the stop 92 to slip off the lower end 105 of edge 50. The asymmetrical geometry of the angle along with the limited length of slot 66 does not permit the angle 60 to move downwardly beyond the position of FIG. 5F to a position corresponding to the position of FIG. 5D wherein the flange 64 of angle 60 is perpendicular to the edge 50.

The action of the ottoman angle described above allows the footrest to displace from its "normal" position when any obstruction is encountered. Typically, an obstruction may be encountered as the ottoman assembly is returned to the retracted position of FIG. 2 from the extended position of FIG. 1 as the chair is brought to an upright position from a reclined position. Of primary concern is the obstruction created by a small child or pet that may crawl under the chair and place a part of the body such as a limb extremity behind the footrest as it is being retracted. This may occur particularly when the child or pet is unobserved by the chair occupant. If some means is not provided to relieve the pressure applied to the limb by the ottoman board, serious injury may result.

In accordance with the present invention, if the ottoman board 80 encounters an obstruction that engages the back surface of the board beneath the pin and slot connection joining the angle 60 and bracket 30, the board 80 along with the footrest 82 mounted on it and the ottoman angle 60 which carries it will together tilt upwardly against the resistance of spring 49 to the position of FIG. 5B or beyond to the positions of FIG. 5C and 5D. If the angle pivots to the position of FIG. 5C or 5D, it will remain elevated until forced downwardly against the bias of spring 49 and/or the resistance of the stop 90 on the top edge 103 of the bracket. If, on the other hand, the obstruction encountered is above the pin and slot connection, the board 80 along with the footrest and the ottoman angles will pivot downwardly to the position of FIG. 5E or beyond to the position of FIG. 5F. If the position of FIG. 5F is reached, the ottoman angles 60 along with the board 80 and footrest 82 will remain tilted even against the action of spring 49.

The asymmetrical configuration of the ottoman angle described-above imposes a greater force requirement to reach the position of FIG. 5F than to reach the position of FIG. 5C. This feature is provided to prevent the accidental locking of the footrest in the downwardly tilted position by the chair occupant should his or her foot press forwardly against the upper edge of the footrest 82. It will be appreciated that such a force will tend to rotate the footrest forwardly and downwardly with respect to the bracket 30, and because the force necessary to overcome the spring and reach the locked position is greater in that direction, the likelihood of unintentionally locking of the footrest in the displaced position of FIG. 5F is diminished.

From the foregoing description, those skilled in the art will appreciate that with the simple addition of a bracket and spring, a safety feature is introduced into the ottoman assembly which otherwise is not present. The mechanism is such that an obstruction encountered either adjacent the top or the bottom of the footrest 82 as the assembly is retracted in the direction of arrow R in FIG. 1 will cause the footrest 82 to pivot with respect to the brackets 30 so as not to injure anyone or anything which may be trapped behind it. In addition, if the obstruction is sufficiently large or the force generated by it is great, the footrest 82, board 80 and angles 60 will swing and lock in the displaced position of FIGS. 5C, D and F so as not to continue to squeeze against the obstruction.

Because numerous modifications may be made of this invention without departing from its spirit, it is not intended that the breadth of this invention be limited to the specific embodiment illustrated and described. Rather, it is intended that the scope of this invention be determined by the appended claims and their equivalents.

What is claimed is:

1. A safety ottoman assembly movable between extended and retracted positions comprising a pair of spaced apart and parallel side brackets for mounting on a mechanism to move the assembly including the brackets between the retracted and extended positions, a pair of ottoman angles each having a plate essentially parallel to the brackets with one angle being associated with each bracket, each angle also having a flange substantially perpendicular to the plate and lying forward of the bracket with which it is associated, said flanges being provided for supporting an ottoman board, a slot provided in the plate of each angle and a pin mounted on each bracket and extending into the slot of the associated angle for supporting the angles on the brackets and enabling the angles to move rearwardly and forwardly on the brackets and also permitting the tops and bottoms of the angles to pivot away from the brackets, a pair of stops carried on each angle plate, one adjacent to the top and the other adjacent the bottom thereof and limiting the rearward travel of the angles on the brackets, and a spring joining the associated angles and brackets and biasing the angles to a rearward position on the brackets.

2. A chair having a safety ottoman assembly movable between an extended and retracted position with respect to the chair seat, said ottoman assembly being carried by a pair of mechanisms mounted one each on one of a pair of lazy tong linkages with one mechanism on each side of the seat, each of said mechanisms biasing the ottoman assembly in a first normal position with respect to the lazy tong linkages but enabling the ottoman assembly to move to at least one displaced position with respect to the linkages when an obstruction is encountered and comprising a bracket having a plate oriented in a vertical plane parallel to the side of the chair and mounted on the end of one of the lazy tong linkages, said plate having a front bearing edge which is essentially vertical when the ottoman assembly is retracted and approximately horizontal when the ottoman is extended, an ottoman angle having a plate closely adjacent and parallel to the plane of the bracket plate and having a pair of supports carried on the plate which bear against the bearing edge of the bracket plate when the ottoman assembly is in the normal position, a pin carried by one of the plates and a slot in the other of the plate and receiving the pin enabling the angle to move relative to the bracket, a flange forming part of the angle and extending perpendicularly outwardly from the angle plate and on which the ottoman is rigidly mounted, and spring means connected between the angle and the bracket resiliently urging the ottoman assembly into the normal position but enabling the ottoman assembly to move to other positions when an obstruction is encountered as the ottoman assembly is moving with the lazy tong linkage to its retracted position, said spring means urging the ottoman to some of said other positions when the ottoman has moved a preselected distance from the normal position.

3. A chair having a safety ottoman as defined in claim 2 wherein said slot is substantially horizontal when the ottoman is retracted and in the normal position.

4. A chair having a safety ottoman as defined in claim 3 wherein said slot is in the plate of the ottoman angle.

5. A chair having a safety ottoman as defined in claim wherein said spring means is a coil spring connected at one end to the angle and at the other end to the bracket.

6. A chair having a safety ottoman as defined in claim 2 wherein said lazy tong linkage includes an upper and lower link having forward ends which are connected to the bracket plate at separate points above and below the slot, respectively, when the ottoman is retracted.

7. A chair having a safety ottoman as defined in claim 6 wherein the supports lie above and below the slot when the ottoman is retracted.

8. A chair having a safety ottoman as defined in claim 2 wherein one of the supports lies above the other when the ottoman is retracted and each separately serves as a pivot point enabling the bracket to pivot upwardly and forwardly from the bottom of the bracket about the upper of the supports when an obstruction is engaged by the bottom of the ottoman assembly and to pivot downwardly and forwardly from the top of the bracket about lower of the supports when an obstruction is engaged by the top of the ottoman assembly.

9. A chair having a safety ottoman as defined in claim 8 wherein said slot is substantially horizontal when the ottoman is retracted and in the normal position.

10. A chair having a safety ottoman seat as defined in claim 9 wherein said slot is in the plate of the ottoman angle.

11. A chair having a safety ottoman as defined in claim 9 wherein the slot is closer to the upper of the supports than the lower of the supports.

12. A chair having a safety ottoman as defined in claim 8 wherein said spring means is a coil spring connected at one end to the angle and at the other end to the bracket.

13. A chair having a safety ottoman as defined in claim 2 wherein the upper of the supports is slidable along the bearing edge of the bracket and over the top edge thereof to retain the angle in an upwardly tilted position and the lower of the supports is slidable along the bearing edge of the bracket and over the bottom edge thereof to retain the angle in a downwardly tilted position.

14. A chair having a safety ottoman as defined in claim 13 wherein the pin is nearer to the upper of the supports than the lower of the supports.

15. A chair having a safety ottomon as defined in claim 14 wherein the length of the slot and position of the pin enable the angle to pivot upwardly to a position substantially perpendicular to the bearing edge of the bracket.

16. A chair having a safety ottoman as defined in claim 15 wherein the length of the slot and position of the pin prevents the angle from pivoting downwardly to a position substantially perpendicular to the bearing edge of the bracket.

* * * * *